US005536147A

United States Patent [19]

Lang

[11] Patent Number: 5,536,147

[45] Date of Patent: Jul. 16, 1996

[54] VACUUM PRIMING SYSTEM FOR CENTRIFUGAL PUMPS

[75] Inventor: David P. Lang, Oakland, Calif.

[73] Assignee: Paco Pumps, Inc., Oakland, Calif.

[21] Appl. No.: 296,653

[22] Filed: Aug. 26, 1994

[51] Int. Cl.[6] ..... F04B 23/08

[52] U.S. Cl. ..... 417/199.2; 417/200

[58] Field of Search ..... 417/199.2, 200, 417/201

[56] References Cited

U.S. PATENT DOCUMENTS

| | | | |
|---|---|---|---|
| 2,883,936 | 4/1959 | Daddario | 417/200 |
| 3,121,397 | 2/1964 | Daddario | 417/200 |
| 4,249,865 | 2/1981 | Sloan | 417/200 |
| 4,515,180 | 5/1985 | Napolitano | 417/200 |

*Primary Examiner*—Charles Freay
*Attorney, Agent, or Firm*—Bielen, Peterson & Lampe

[57] ABSTRACT

A self-priming pump system including a vacuum priming unit and a liquid pumping unit, the pumping unit having an engine driven centrifugal pump with an intake conduit, the priming unit having a vacuum column with an internal well chamber and a vacuum chamber above the well chamber with an interconnecting gas relief passage, the well chamber having liquid level sensors to detect the water level in the well chamber and activate a vacuum control valve connecting a vacuum pump to the vacuum chamber when the water level in the well chamber falls below a predetermined level, the control valve switching to seal the vacuum chamber and connect the vacuum pump to atmosphere when a predetermined level of water is detected in the well chamber.

11 Claims, 2 Drawing Sheets

VACUUM PRIMING SYSTEM FOR CENTRIFUGAL PUMPS

BACKGROUND OF THE INVENTION

This invention relates to a priming unit for liquid pumps, particularly high volume, portable water pumps. When incorporated into a pumping unit, the priming unit enables the modified pumping unit to be a self-priming pump that automatically primes the suction line to the pump for high capacity operation. The pumping systems of this type are frequently used for irrigation purposes and dewatering of flooded zones or for other purposes where less than a thirty foot suction lift and high volume discharge is required. The automatic priming unit of the pump system utilizes a vacuum pump to evacuate air out of the suction line allowing the line to draw fluid for the main pump intake.

Although vacuum pump priming units for pump systems have been proposed in the past, the units lack the control features necessary to allow the pump unit to be operated both under conditions where there is a negative head in the suction line or a positive head in the line. Frequently, the latter condition will cause a vacuum pump, which is a gas medium component in a liquid pumping system to be flooded with liquid, resulting in damage to the gas medium pump.

Furthermore, a vacuum priming unit that is vacuum sealed during normal operation of the main pumping unit is desirable to substantially reduce the load on the vacuum pump and to protect the pump. Where the pump system is electrically operated with a drive motor for the primary pump of the pumping unit and an auxiliary motor driving the vacuum pump of the priming unit, the vacuum pump can be shut down during normal operation of the primary pump and started as needed. In portable systems where the primary pump is driven by an internal combustion engine and the vacuum pump is driven by a power take off on the engine, the vacuum pump can be diverted to an atmospheric intake to substantially reduce the workload demand of the vacuum pump. Furthermore, where air is drawn into the intake line, the priming unit is designed to rapidly reprime the pumping unit for continuous operation. These and other features of the improved self-priming pump system will be described in greater detail hereinafter.

SUMMARY OF THE INVENTION

The self-priming pump system of this invention is constructed as a component assembly that combines a priming unit and a pumping unit. A high capacity vacuum pump in the priming unit is operated in conjunction with a high-volume centrifugal pump in the pumping unit, where it is desirable to automatically prime and reprime the pump for continuous operation. Frequently, high-volume centrifugal pumps provide excellent transfer of liquid medium, but are incapable of developing the necessary vacuum pressure to draw the liquid from the liquid source to the pump inlet to initiate the high-volume transfer.

The vacuum priming unit is a component assembly that is added to a centrifugal liquid pumping unit to enable the pumping unit to be automatically primed to draw liquid from a negative head up to thirty feet. The priming unit is designed to enable the pump system to operate under both negative and positive head and reprime whenever air is drawn into the pump system.

The vacuum priming unit includes a vacuum column with an internal sealable priming cavity divided into a vacuum chamber connected to a vacuum pump and a well chamber connected to the intake of the priming pump of the pumping unit. The well chamber communicates with the intake conduit of the priming pump and includes level sensors to monitor the liquid level in the well chamber and to activate the evacuation of air from the priming cavity when a low level of liquid is detected. In a preferred embodiment, the pumping unit includes an internal combustion engine directly operating the centrifugal pump of the pumping unit and, by a power take-off, operating the vacuum pump. The vacuum pump is switched from communication with the vacuum chamber to communication with the atmosphere.

The level sensors comprise level sensing switches that actuate electronically operated control valves to switch a suction line from the vacuum pump from communication with atmosphere while sealing the cavity, to communication with the vacuum chamber to evacuate air from the two chambers forming the cavity. Protective valving between the well chamber and vacuum chamber prevents liquid from being drawn into the vacuum chamber and the vacuum pump during the evacuation procedure.

Upon determination that a predetermined level of water is present in the well chamber, the level sensors activate the switching of the vacuum pump to atmosphere. Simultaneously, a protective condensate valve in a water air separator in the suction line is opened for returning collected condensate to the intake conduit of the centrifugal pump. A protective float valve and check valve between the well chamber and the vacuum chamber of the vacuum column prevent liquid from entering the vacuum chamber when the vacuum chamber is evacuated for drawing liquid into the well chamber.

With modification, the vacuum priming unit can be adapted for use with electric motors driving the centrifugal pump and the vacuum pump. In such instance, the vacuum pump motor can be turned off during periods of normal pumping operation of the centrifugal pump after priming and sealing of the priming cavity. The level sensors in the modified system activate power switches to the vacuum pump to save power in addition to activating the control valve to seal the priming cavity.

These and other features of the invention are detailed in the following Detailed Description of the Preferred Embodiments.

DETAILED DESCRIPTION OF THE PREFERRED EMBODIMENTS

Figure 1:
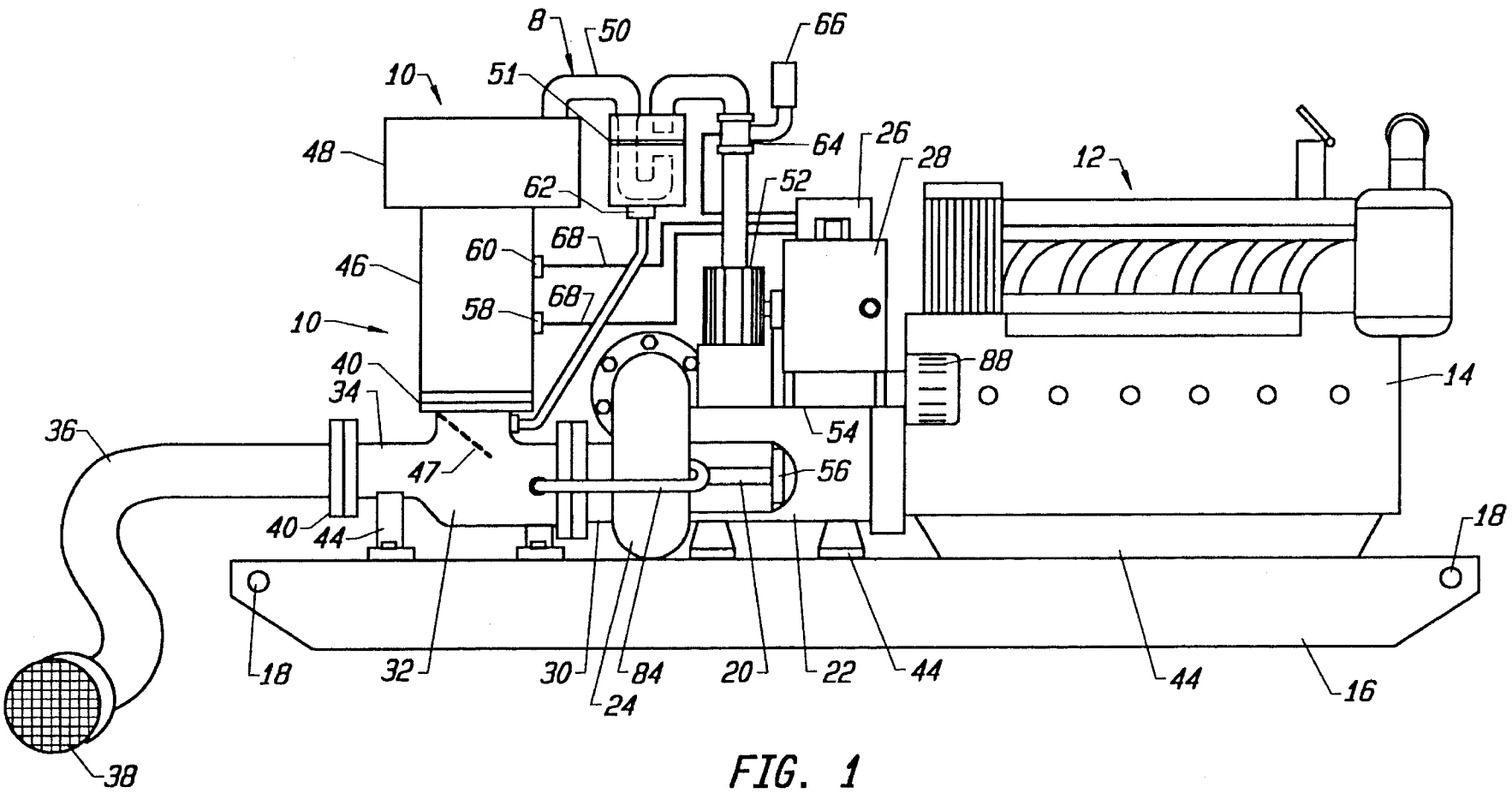
FIG. 1 is a side elevational view of the vacuum priming system with a centrifugal pumping unit.

The self-priming pump system, designated generally by the reference numeral 8, is shown in FIG. 1. The self-priming pumping system 8 includes a vacuum priming unit 10 integrated with a centrifugal pumping unit 12. It is to be understood that the pumping unit 12 includes components that may be varied according to the particular application and that the vacuum priming unit 10 may be incorporated in any engine or motor driven pumping configuration that requires or is advantageously assisted by a priming system to prime the pump, typically a centrifugal pump, of a pumping unit 12.

The pumping system 8 of FIG. 1 is a typical skid-mounted installation for portability that combines a pump unit 12 with a priming unit 10. It is to be understood that the pumping unit with an incorporated priming unit can be mounted on a trailer or other means of conveyance. The pump system of FIG. 1 is designed for portability and is generally moved to the site where the system is operated. A pumping unit that is designed as a permanent installation with available electrical power would preferably include a centrifugal pump driven by an electric motor instead of an internal combustion engine. An incorporated priming unit would similarly include a vacuum pump driven by an electric motor. Except for the powering means, the system operates essentially the same as an engine driven system.

The skid-mounted pump system 8 of FIG. 1 includes a pumping unit 10 having an internal combustion engine 14 secured to a skid platform 16 having eyelets 18 for hoisting the pumping unit 12 onto a flat bed or other vehicle for transportation. The engine 14 has a drive shaft 20 protected by a bell housing 22 on which is mounted a centrifugal pump 24. The primary pump 24 is driven by the drive shaft 20 under operational control of an electronic control module 26 housed in a control panel 28. The primary pump 24 is typically a high volume centrifugal pump for liquids that is advantageously assisted by priming to initiate a pumping from a liquid source at a level below the pump inlet. However, because portable pump systems are frequently used in different situations where both a negative head and positive head may be encountered, the priming unit 10 must be such that it is not adversely affected when the pump system 8 is operated in the situation where there is a positive head at the inlet.

In the embodiment of the vacuum priming system 8 shown in FIG. 1, the primary pump 24 has an inlet 30 that connects to the intake conduit 32, which in the embodiment of FIG. 1, includes an off-set, T-fitting 34 coupled to the pump inlet 30 and to a flexible suction hose 36 with an end screen 38. The T-fitting 34, flexible hose 36, pump 24 and vacuum priming system 10 have flanged couplers 40 for convenience in assembly.

The pump 24 includes a liquid discharge outlet 42 that discharges liquid to a discharge conduit (not visible) from the back of the pump unit 12 shown in FIG. 1. A discharge conduit can include any type of piping conduit or flexible hose system for delivery of the pumped liquid to the location desired. The engine 14, bell housing 22, pump 24 and T-fitting 34 are supported by mounting brackets 44 that secure the components to the skid-platform 16.

The priming unit 10 of the self-priming pump system 8 includes a priming column 45 divided into a well chamber 46 and a vacuum chamber 48. The well chamber 46 is coupled to the off-set T-fitting and includes a plate deflector 47 to direct the dynamic flow of intake liquid into the inlet 30 of the primary pump 24. At the top of the vacuum chamber 48 is a connecting passage 53 that connects to an air-water separator 51. The air-water separator 51 has a gas suction line 50 that is connected to a vacuum pump 52. The vacuum pump 52 is preferably a rotary vane type pump that utilizes oil lubrication from the lubricating oil sump 54 for efficient, positive displacement operation. The rotary vacuum pump 52 is driven via a drive belt assembly 56 connected to the drive shaft 20 of the engine 14. The well chamber 46 of the priming column includes level sensor switches 58 and 60 to detect the level of priming water in the well chamber 46 and activate certain events under control of the control module 26. Control of the water level is accomplished by solenoid operated control valves 62 and 64 which are electronically operated via the control module. The two-way, solenoid operated control valve 64, selectively connects the vacuum pump 52 to the vacuum chamber 48 or to atmosphere via a filtered air intake 66. The operation of the vacuum priming unit 10 is regulated by the control module 26 in the control panel 28 via electronic circuit lines 68 leading from the sensor switches 58 and 60 to the control valves 62 and 64 in the pump system 8 of FIG. 1.

Figure 2:
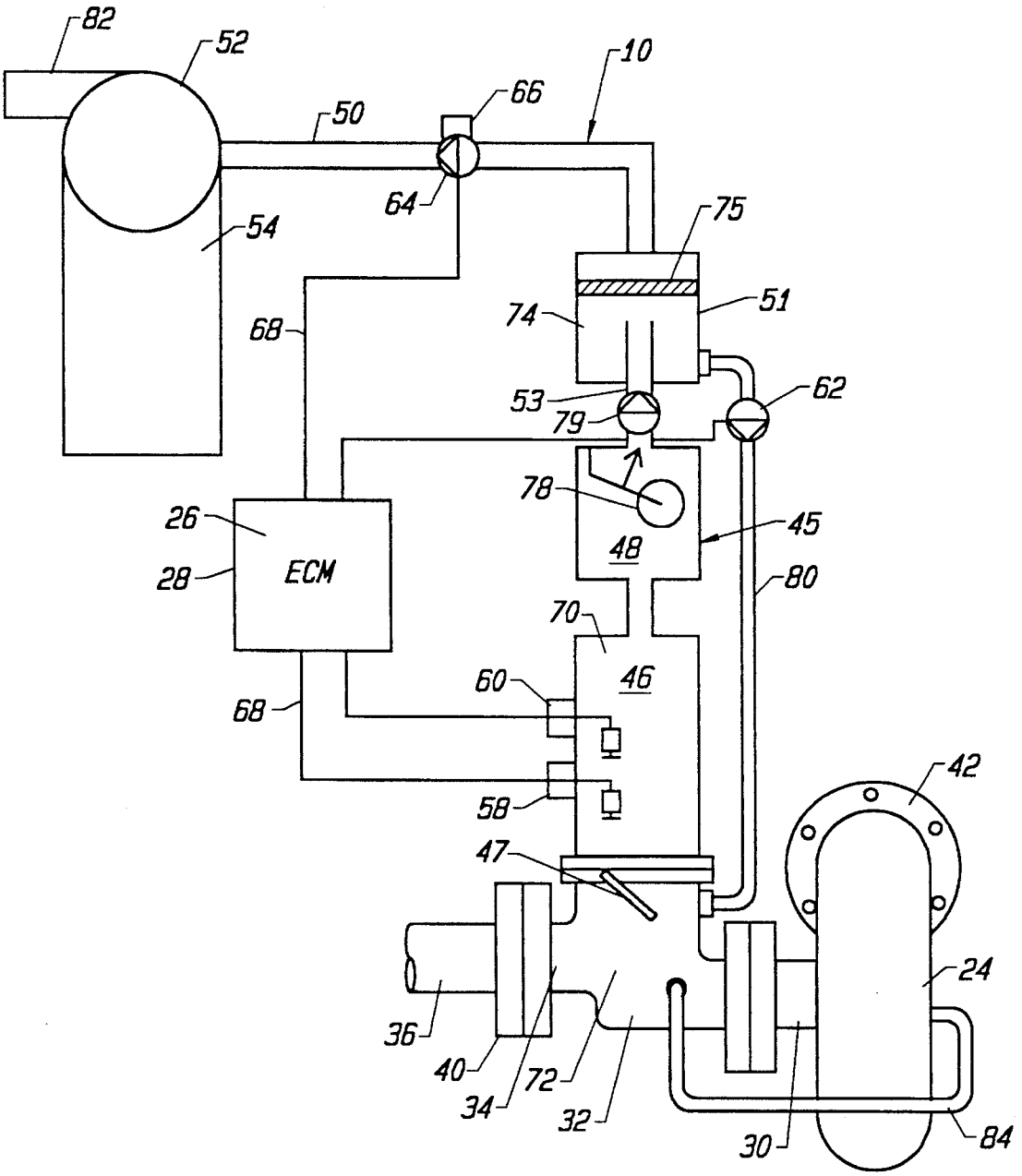
FIG. 2 is a schematic illustration of the principal operating components of the vacuum priming system of FIG. 1.

Referring now to FIG. 2, a schematic illustration of the self-priming pump system 8 shows internal components of the priming unit 10 that are important to the controlled operation of the system. As schematically shown, the well chamber 46 of the priming column 45 has an internal reservoir 70 that is in direct communication with the internal passage 72 of the off-set, T-fitting 34 that forms part of the inlet conduit 32 leading to the pump 24. When the internal reservoir 70 is partially filled with liquid to at least the level of the lower sensor switch 58, the inlet conduit is sufficiently filled such that the centrifugal pump 24 is primed and able to draw and discharge liquid through the pump system.

In operation, the vacuum priming unit 10 of the pump system 8 shown in FIG. 2 functions in the following manner. When the engine starts, the control panel 28 is powered to activate the control circuitry of the control module 26. The engine drives the belt connected vacuum pump 52 to generate a suction in air suction line 50. In the instance where the reservoir 70 of the well chamber 46 is empty, level sensors 58 and 60, which comprise float switches, are open signalling that their is no liquid in the well chamber 46. When such condition is sensed by the control module 26 in the control panel 28, a two-way control valve 64 remains in its deactivated default position and connects the vacuum in suction line 50 to the vacuum chamber 48. In this position, the two-way control valve blocks communication of the suction line 50 with the air intake 66.

To insure that liquid or vapor does not pass to the vacuum pump, which may result in damage to the pump, the suction line 50 includes the air water separator 51 between the vacuum chamber 48 and the vacuum pump 52. The air water separator 51 has a vapor chamber 74 with a condensate filter screen 75, which condenses vapor and to a condensate and collects condensed vapor in the chamber for return to the water portion of the system via return line 80 that connects to the intake passage 72 through the T-fitting 34. The vacuum chamber 48 includes a float valve 78 and a check valve 79 that allows air drawn from the well chamber 46 to pass from the vacuum chamber 48 to the air water separator 51 and prevent any return passage of air or forward passage of liquid in the event that the pump unit 12 is connected to a liquid supply with a positive head or in the event of failure of the float switches 58 and 60 during vacuum operation.

The control valve 62 in the condensate return line 80 is maintained in the closed position, its default position, during the vacuum connection of the vacuum pump 52 to the priming column 45. As a result, vacuum is generated in the vacuum chamber 48, in the well chamber 46 and in the intake passage 72 that communicates with the flexible suction hose 36 of the pumping unit 12 in FIG. 1.

The vacuum suction generated by the rotary vacuum pump 52 draws water through the end of the flexible hose 36, when immersed in liquid, and into the inlet passage 72. Air is evacuated through the vacuum pump to the gas discharge 82 on the vacuum pump that communicates with atmosphere. As the water level rises in the priming chamber 46, first the lower sensor switch 58 closes, and subsequently the upper level sensor switch 60 closes, signalling that the priming chamber is filled with the desired priming level of liquid for adequate priming of the pump 24. When both sensor switches 58 and 60 are closed, the two-way control valve 64 is automatically switched by the control module 26 to connect the vacuum pump to the atmospheric intake 66, which minimizes the work load on the vacuum pump during the sealed phase of the vacuum priming system. Simultaneously with the switching of the two-way control valve 64, the condensate control valve 62 opens allowing any collected water in the vapor chamber 74 of the air-water separator 51 to discharge through discharge line 80 to the intake passage.

The system 10 remains in this sealed state until air is drawn into the system which collects in the priming column 45 lowering the water level in the well chamber 46. When the water level drops to the point that the lower level sensor switch 58 opens, the control module 26 deactivates the condensate control valve 62 closing the condensate return line 80, and switches the two-way vacuum control valve 64 to its default position, connecting the vacuum generated by the vacuum pump to the vacuum chamber 48 and well chamber 46 to remove the air and draw liquid further into the well chamber 46 until the level of the liquid in the chamber 46 again reaches the upper level sensor switch 60 causing the system to again return to the operational, vacuum-sealed state.

With the control valve 62 in the normally closed position, and, with the air relief valve 78 being mechanically operated by floatation, the system is designed to allow connection of the inlet conduit 32 to a liquid source having a positive head prior to starting the engine or activating the power system for regulated operation.

To improve evacuation of the air from the pump intake 30 an air purge line 84 is routed to the backside of the pump 24 to draw air from the vortex during the priming operation. This addition is not required, but reduces the time for priming and repriming when air is drawn into the inlet conduit 32.

The electronic circuitry 68 and electrically operated control components are selected for 12V D.C. operation powered from an alternator 88 on the engine. It is to be understood that the preferred embodiment, the control module simply comprises an interconnect terminal for routing power through the float switches and to the control valves for selective activation of the valves. Where level sensors that are not integral switches or where other electronic components are used, particularly in a motor driven system, various AC/DC converters and similar standard components will comprise the control module.

Food processing float switches are preferably used as the sensor switches in the priming chamber because of their reliability under different liquid mediums. 12V ASCO full vacuum control valves are used for the vacuum pump control valves. The vacuum pump in the embodiment described is a Massport M-2 30 CFM pump. Where the liquid pump is driven by a motor, equivalent A.C. components are utilized and the vacuum pump may advantageously be driven by a separate motor with operation suspended during periods that the vacuum column is vacuum sealed during normal pumping operations of the primary pump.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A vacuum priming system for use with liquid pumps having an inlet conduit with an inlet passage leading to a liquid source comprising:

a vacuum column proximate the liquid pump connected to the inlet conduit, the vacuum column having a well chamber in communication with the inlet passage, the well chamber including liquid level sensor means positioned higher than the inlet passage of the liquid pump for detecting a liquid level in the well chamber of the vacuum column, the vacuum column having a vacuum chamber located above the well chamber with valve means for passing gas and preventing the passage of liquid from the well chamber to the vacuum chamber;

a vacuum pump with a gas discharge communicating with atmosphere and a suction inlet having a suction line with vacuum control valve means located between the vacuum pump and the vacuum chamber for switching the vacuum pump between one position in communication with the vacuum chamber and another position in communication with atmosphere with the vacuum chamber blocked from the vacuum pump; and, drive means for operating the vacuum pump and switching means for switching the vacuum control valve means to a first position in communication with the atmosphere, when the liquid level sensor means detects liquid in the well chamber and to a second position in communication with the vacuum chamber when the liquid level sensor means fails to detect liquid in the well chamber.

2. The vacuum priming system of claim 1 wherein the liquid level sensor means comprises a first liquid level float switch located at a first level in the well chamber which detects a first liquid level in the well chamber and a second liquid level float switch located at a second level in the well chamber above the first level which detects a second liquid level in the well chamber wherein said switching means switches the vacuum control valve means to the first position when the second level float switch detects liquid in the well chamber at the second liquid level and said switching means switches the vacuum control valve means to the second position when the first level float switch detects that liquid detected in the well chamber at the second level has dropped to the first liquid level.

3. The vacuum priming system of claim 2 wherein the first liquid level switch and the second liquid level switch each have an open and closed position wherein the switching means switches the vacuum control valve means to an activated second position when the first liquid level switch is closed and the second liquid level switch is closed, and switches the vacuum control valve means to a deactivated first position when the first liquid level switch is open and the second liquid level switch is open, wherein on initiating operation of a liquid pump having the vacuum priming system, the vacuum pump initiates operation and on initiation the first liquid level switch is open, the second liquid level switch is open, and the vacuum pump communicates with the vacuum chamber through the suction line and vacuum control valve means.

4. The vacuum priming system of claim 1 comprising further a gas and condensate separator located in the suction line, wherein the gas and condensate separator has condensate separation means for collecting condensate and returning collected condensate to the inlet passage of the inlet conduit.

5. The vacuum priming system of claim 4 wherein the gas and condensate separator includes a condensate screen for condensing vapor, a condensate collection chamber for collecting condensate and a condensate return line interconnecting the collection chamber and the intake conduit for return of collected condensate to the intake passage of the liquid pump.

6. The vacuum priming system of claim 5 wherein the condensate return line includes a condensate control valve means actuated by the switching means for return of condensate to the intake passage of the liquid pump wherein the condensate control valve means is simultaneously switched together with the vacuum control valve means, wherein the vacuum pump communicates with the vacuum chamber, the condensate control valve is closed, and when the vacuum pump communicates with atmosphere and the vacuum chamber is sealed the condensate control valve is open allowing condensate to pass from the condensate collection chamber to the intake passage of the liquid pump.

7. The vacuum priming system of claim 1 including a connecting passage between the well chamber and the vacuum chamber wherein the valve means of the vacuum chamber includes a float valve arranged in the connecting passage to block the connecting passage when the liquid level in the well chamber rises to the connecting passage and a check valve arranged in the connecting passage to pass gas from the well chamber to the vacuum chamber.

8. The vacuum priming system of claim 7 wherein the inlet conduit includes an off-set, T-fitting wherein the vacuum column is connected to the offset T-fitting.

9. The vacuum priming system of claim 8 wherein the off set T-fitting includes a deflector plate and the liquid pump has an intake wherein the deflector plate is arranged to direct liquid in the inlet passage of the inlet conduit to the intake of the liquid pump.

10. A self-priming pump system comprising:

a centrifugal pump for pumping liquids, the centrifugal pump having an intake with an intake passage and a discharge with a discharge passage;

drive means for driving the centrifugal pump;

automatic priming means for priming the centrifugal pump wherein the automatic priming means includes;

a priming column communicating with the intake passage of the centrifugal pump, the priming column being divided into a well portion and a vacuum portion, the well portion being elevated from the pump intake and having sensor means for sensing the level of liquid in the well portion of the priming cavity, the vacuum portion being located above the well portion and having a connecting passage communicating with the well portion, the connecting passage having flow valve means for passing gas from the well portion to the vacuum portion and blocking liquid from passing from the well portion to the vacuum portion; and, a vacuum pump having a communication passage with the vacuum portion of the priming column, the communication passage having control valve means connected to the sensor means wherein the control valve means closes the communication passage between the vacuum pump and the priming column when a predetermined level of liquid is detected in the well portion of the priming column by the sensor means and opens the communication passage between the vacuum pump and the priming column when a predetermined level of liquid is not detected in the well portion of the priming column by the sensor means.

11. The self-priming pump system of claim 10 comprising in addition:

a gas-liquid separator in the gas passage between the vacuum pump and the vacuum portion of the priming column, the gas-liquid separator having means for separating liquid from the gas and returning the liquid to the liquid intake passage of the centrifugal pump.

* * * * *